United States Patent [19]

Terzian

[11] Patent Number: 4,878,874

[45] Date of Patent: Nov. 7, 1989

[54] SELECTIVELY ROCKING OR WALKING DOLL

[75] Inventor: Rouben T. Terzian, Chicago, Ill.

[73] Assignee: Marvin Glass & Associates, Chicago, Ill.

[21] Appl. No.: 309,635

[22] Filed: Feb. 9, 1989

[51] Int. Cl.[4] ..... A63H 11/18

[52] U.S. Cl. ..... 446/355; 446/276

[58] Field of Search ..... 446/355, 352–354, 446/356, 307–309, 312, 311, 368, 276, 278, 286, 288, 290–294, 317; 40/414, 418, 420

[56] References Cited

U.S. PATENT DOCUMENTS

| | | | |
|---|---|---|---|
| 2,667,719 | 2/1954 | Edwardson | 446/355 |
| 3,178,853 | 4/1965 | Greenwood et al. | 446/356 |
| 4,349,987 | 9/1982 | Bart | 446/355 |
| 4,629,440 | 12/1986 | McKittrick et al. | 446/356 |

OTHER PUBLICATIONS

Kokai No. 52-6249, Japan, Jan. 18, 1977.

*Primary Examiner*—Mickey Yu
*Attorney, Agent, or Firm*—John S. Pacocha

[57] ABSTRACT

A character includes legs that pivot as well as move up and down relative to the torso either in an alternating, out of phase, walking simulating motion or simultaneously, in phase, to simulate rocking, as selected by the user. Movement of the legs is effected by a reversible motor driving a pair of crank disks that engage the legs connected to the torso by a pin received in a slot. One disk is fixed to the shaft and the other disk is rotatable about the shaft but is engaged by a peg that is received in a semicircular recess in a face of the other disk to, depending on the direction of rotation of the shaft, either drive the other disk in phase with the fixed disk or out of phase with the fixed disk.

3 Claims, 1 Drawing Sheet

SELECTIVELY ROCKING OR WALKING DOLL

BACKGROUND OF THE INVENTION

1. Field of the Invention

This invention relates generally to dolls, characters or figures and more particularly to dolls, characters or figures with articulated legs that simulate walking and the like.

2. Background Art

Dolls with motor driven movable limbs are old in the art as are dolls having articulated legs that in combination with a supporting accessory simulate walking of the doll. Prior art examples of dolls supported by a wheeled accessory for ,simulated walking are shown in U.S. Pat. Nos. 1,684,287 issued Sept. 11, 1928 to Paluck; 3,940,879 issued Mar. 2, 1976 to Glass et al. and 4,386,479 issued June 7, 1983 to Terzian et al. U.S. Pat. No. 4,312,150 issued Jan. 26, 1982 to Terzian discloses a doll capable of raising itself from a generally prone position with the head of the doll being movable between two positions to determine the shut off time of a drive mechanism and hence, whether the doll will raise itself to either a sitting or a standing position. A controlled dual-action doll that will either jump up and down or shake her head "No", depending on the direction of rotation of a motor in response to selective actuation of different switches is disclosed in U.S. Pat. No. 3,568,361 issued Mar. 9, 1971 to Bart et al. Angularly displaced cams drive the arms of a swimming figure in an alternating "Australian crawl" motion in the doll disclosed in U.S. Pat. No. 3,693,292 issued Sept. 26, 1972 to Di Leva. However, there remains a need for a character that will selectively simulate walking by alternate, out of phase, movement of its legs or rocking back and forth by simultaneous, in phase, movement of its legs.

SUMMARY OF THE INVENTION

The present invention is concerned with providing a character having legs that pivot as well as move up and down relative to the torso either in an alternating, out of phase, walking simulating motion or simultaneously, in phase, to simulate rocking, as selected by the user. A reversible motor drives a pair of crank disks that cause the movement of the legs. One disk is fixed to the shaft and the other is rotatable about the shaft but is engaged by a peg that is received in a semicircular recess in a face of the other disk to, depending on the direction of rotation of the shaft, either drive the other disk in phase with the fixed disk or out of phase with the fixed disk.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figure 1:
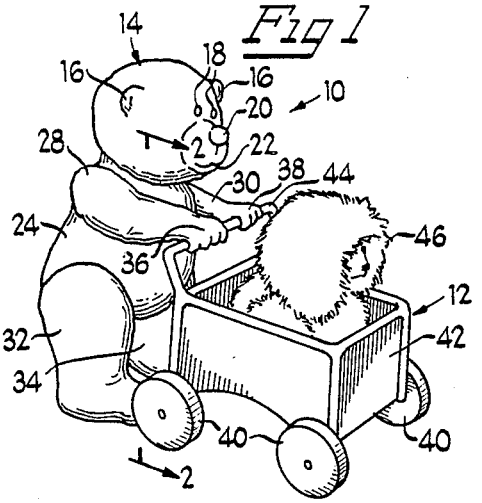
FIG. 1 is a perspective view of the embodiment of the present invention.
Figure 5:
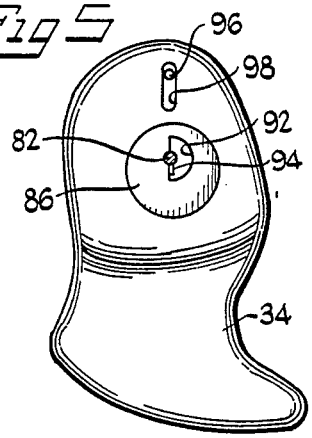
FIG. 5 is a sectional view taken generally along line 5—5 of FIG. 2.
Figure 7:
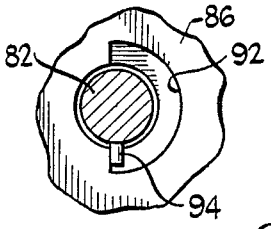
FIG. 7 is an enlarged scale, fragmentary view taken generally along line 7—7 of FIG. 6.
Figure 6:
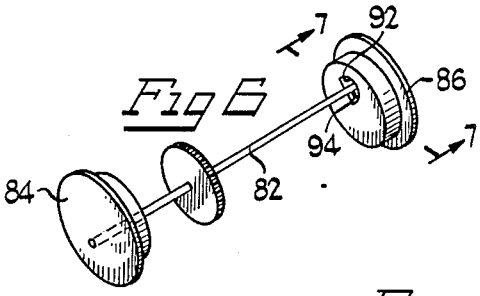
FIG. 6 is an enlarged scale, perspective view of the rotating shaft and crank disks assembly.
Figure 4:
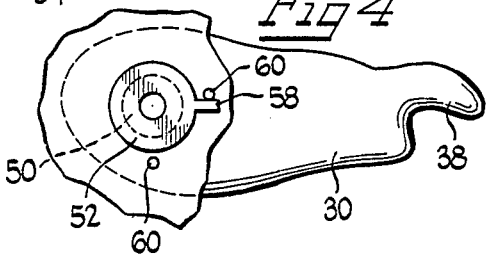
FIG. 4 is a sectional view taken generally along line 4—4 of FIG. 2.
Figure 2:
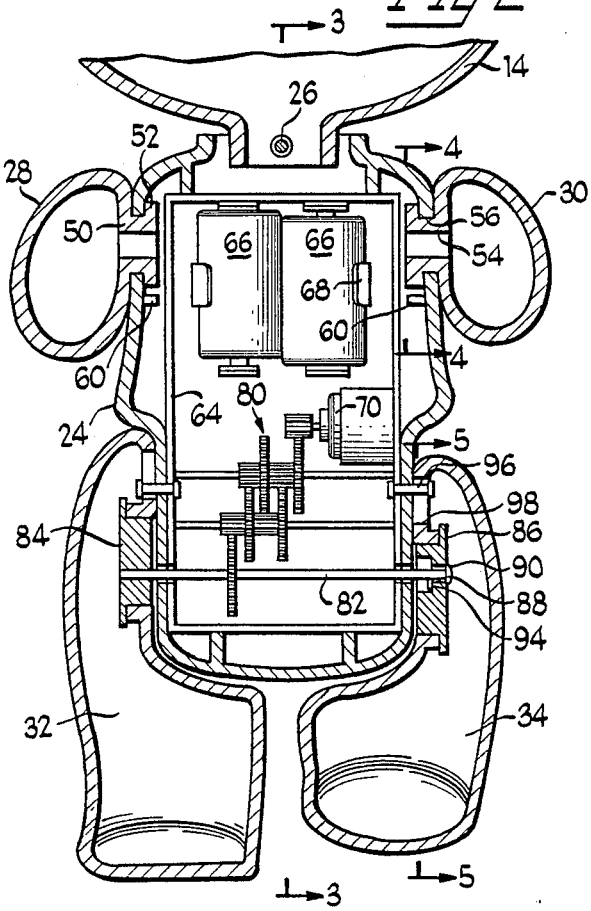
FIG. 2 is an enlarged scale, sectional view taken generally along line 2—2 of FIG. 1.
Figure 3:
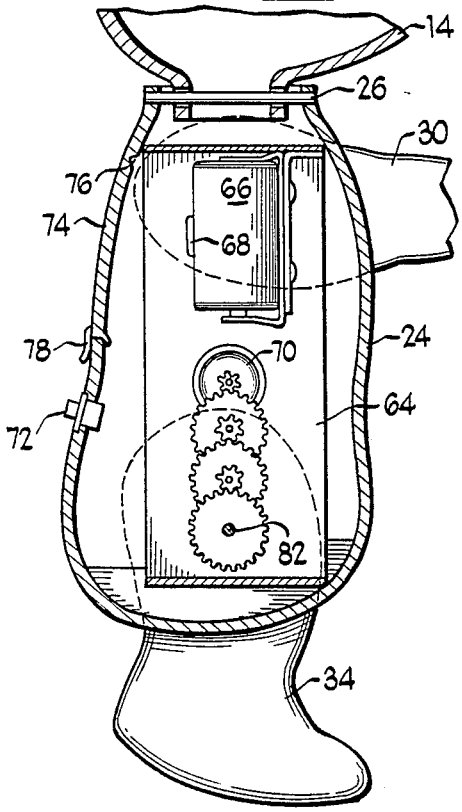
FIG. 3 is a sectional view taken generally along line 3—3 of FIG. 2.

Referring now to the drawings in which like parts are designated by like reference numerals throughout the several views, FIG. 1 shows an animated character 10 supported in an upright position by a wheeled accessory 12. Character 10 has a head 14 with ears 16, eyes 18, a nose 20 and a mouth 22. Head 14 is mounted on a torso 24 for side to side pivotal movement about the axis of a front to back extending rod 26, as is best illustrated in FIGS. 2 and 3. Also attached to torso 24, for movement relative to the torso, are right and left arms 28 and 30 plus right and left legs 32 and 34. Each of arms 28 and 30 have a hand 36 and 38, respectively, formed to grasp an object such as a bar. Head 14, torso 24, arms 28 and 30, legs 32 and 34 plus hands 36 and 38 may all be made of vinyl or some other flexible plastic.

Accessory 12 is conveniently in the form of a cart or pram having four surface engaging wheels 40 rotatable relative to a container 42 that has a rearwardly and upwardly extending handle bar 44. As illustrated in FIG. 1, another toy character 46 may be positioned within container 42. Hands 36 and 38 of character 10 grasp handlebar 44 of the accessory t support the character in an upright position.

Extending in toward torso 24 from adjacent the shoulder of each of the arms is a boss 50 having a flange 52 at the end of the boss spaced from the arm. A bore 54 conveniently extends through boss 50. Adjacent the top of each side of torso 24 is an opening 56 of a size substantially equal to the outer diameter of boss 50 but significantly smaller than the outer diameter of flange 52. Accordingly, as is best illustrated in FIG. 2, once flange 52 is inserted through opening 56 into the interior of torso 24 by temporarily deforming the flange, boss and side of the torso, the arm is then trapped for rotational movement generally about the axis of bore 54.

Flange 52 includes a radially extending bar 58. On the inside of torso 24 are a pair of stops 60 that are spaced apart approximately ninety degrees. Bar 58 engages stops 60 to limit the rotational movement of the arm to an arc of about ninety degrees. Hence, arms 28 and 30 are pivotable between an outstretched position as illustrated in FIG. 1 and a position alongside and generally parallel to the sides of torso 24.

Mounted within torso 24 is a housing 64 that includes a pair of batteries 66 removably carried in a clip 68 and a reversible motor 70. The batteries and motor are connected through suitable wiring (not shown) to a three position, forward-off-reverse, switch 72 mounted in the back of torso 24. As is shown in FIG. 3, the back of torso 24 includes a section 74 which has a living hinge 76 so that section 74 may be pivoted up and away from the rest of the torso to gain access to housing 64 for changing battery 66 as needed. Section 74 is retained in its normally closed position by a simple latch 78.

Motor 70, through a conventional speed reduction gear train 80, rotates a shaft 82. Each of legs 32 and 34 are formed with an opening into which a flanged cylindrical crank disk 84 or 86, respectively, is inserted. Friction, an adhesive, or the like retains each disk in the respective opening and in driving engagement with the respective leg. Disk 84 is secured to shaft 82 for rotation with the shaft off-center from the axis of disk 84. Similarly, shaft 82 fits through a bore 88 in disk 86 off-center from the axis of disk 86. However, because bore 88 is larger than the diameter of shaft 82, disk 86 is free to rotate with respect to shaft 82. A screw 90 or the like prevents disk 86 from being pulled off of shaft 82 along the axis of the shaft.

On the inside face of disk 86 is a semicircular C-shaped recess 92. Secured to shaft 82, generally transverse to the axis of the shaft, is a peg 94 that extends out radially from the shaft and is received in recess 92. It will be appreciated that when peg 94 abuts one end or the other of the semicircular C-shaped recess 92, it will key shaft 82 to disk 86 and the rotation of the shaft will then be transmitted to disk 86. When peg 94 is at the end of recess 92 that is more proximate the center of disk 86, disks 84 and 86 will be angularly offset, approximately one hundred eighty degrees out of phase with each other. However, when peg 94 rotates up to the end of recess 92 that is more proximate the outer periphery of disk 86, which happens when shaft 82 rotates in the opposite direction, then disks 84 and 86 will be angularly aligned and will rotate in phase with each other.

Each of legs 32 and 34 are connected to torso 24 by a pin 96 that is secured to torso 24 and retained in a generally top to bottom elongated slot 98 in the respective leg. Thus, each leg may pivot about the axis of pin 96 and move up and down relative to torso 24, within the limits of slot 98. With character 10 supported in an upright position, such movement of legs 32 and 34, when they are approximately one hundred eighty degrees out of phase, simulates walking and, when the legs are generally in phase, simulates a back and forth, heel-toe, type rocking of the character. Wheeled supporting accessory 12 will be pushed along when character 10 is walking and will be reciprocated back and forth, as is done with a pram to lull a child, when character 10 is rocking. As motor 70 is run in one direction through the operation of switch 72, shaft 82 will drive crank disks 84 and 86 out of phase with each other causing legs 32 and 34, respectively, to move in an alternating manner simulating walking. However, when switch 72 is positioned to run the motor in the opposite direction, crank disks 84 and 86, and hence legs 32 and 34, will be simultaneously moved to simulate rocking back and forth. Particularly when the legs move out of phase, head 14 will pivot from side to side about the axis of rod 26.

While a particular embodiment of the present invention has been shown and described, variations and modifications will occur to those skilled in the art. It is intended in the appended claims to cover all such variations and modifications as fall within the true spirit and scope of the present invention.

What is claimed as new and desired to be secured by Letters Patent is:

1. A character comprising in combination:

a torso having a front and a back plus a top and a bottom;

legs mounted on the torso for pivotal movement between front and back positions along with simultaneous limited up and down movement;

a reversible motor contained in the character; and means for selectively articulating the legs through their pivotal movement between front and back positions along with simultaneous limited up and down movement either in phase or out of phase with each other in response to operation of the reversible motor in one direction or in the opposite direction.

2. The character of claim 1 in which the articulating means comprises:

an off-center crank disk drivingly engaging each leg;

a shaft rotated by the motor;

one of the disks being secured to the shaft for rotation with the shaft;

the other disk being mounted on the shaft to prevent removal of the disk along the axis of the shaft while permitting the disk to rotate relative to the shaft; and means keying the shaft to the other disk to rotate the other disk in phase with the one disk when the shaft is rotated in one direction and to rotate the other disk out of phase with the one disk when the shaft is rotated in the opposite direction.

3. The character of claim 2 in which the keying means comprises:

a face on the other disk;

a semicircular recess in the face;

a peg carried by the shaft and extending out radially from the shaft; and the peg being received in the recess to drivingly engage the other disk when the peg abuts one end or the other of the recess.

* * * * *